United States Patent [19]

Weikel, Jr.

[11] 4,112,298

[45] Sep. 5, 1978

[54] CORONA WIRE MOUNTING MEANS

[75] Inventor: Donald J. Weikel, Jr., Rochester, N.Y.

[73] Assignee: Xerox Corporation, Stamford, Conn.

[21] Appl. No.: 783,359

[22] Filed: Mar. 31, 1977

[51] Int. Cl.[2] ..... H01T 19/04
[52] U.S. Cl. ..... 250/324; 250/326
[58] Field of Search ..... 250/324, 325, 326

[56] References Cited

U.S. PATENT DOCUMENTS

| | | | |
|---|---|---|---|
| 2,922,883 | 1/1960 | Giaimo | 250/326 |
| 3,651,323 | 3/1972 | Tanaka | 250/326 |
| 3,790,999 | 2/1974 | Gallo | 250/326 |

*Primary Examiner*—Harold A. Dixon

[57] ABSTRACT

A corona generating device including an electrically biased corona emitting wire supported adjacent its ends by insulating end blocks. One of the blocks has a recess which houses a coil spring through which the wire passes coaxially. The wire is attached to a mass which bears against the loaded coil spring to maintain the wire in a taut condition.

5 Claims, 2 Drawing Figures

CORONA WIRE MOUNTING MEANS

BACKGROUND OF THE INVENTION

This invention relates to electrostatography. More particularly, this invention relates to corona generating devices for applying electrostatic charge onto a suitable surface and means for maintaining the corona wires of such devices in a taut or tensioned condition during operation.

In the electrostatographic process, an electrostatographic plate comprising a photoconductive insulating material on a conductive backing is given a uniform electric charge over its surface and is then exposed to the subject matter to be reproduced usually by conventional projection techniques. This exposure discharges the plate areas in accordance with the radiation intensity which reaches them and thereby creates an electrostatic latent image on or in the plate coating which may then be developed into a visible form by applying a developer material to the plate using any one of a number of development techniques generally known and used in the art. The developer material electrostatically clings to the plate in a visual pattern corresponding to the electrostatic image. Thereafter, the developed image is usually transferred from the plate to a support material, such as paper, to which it may be fixed by any suitable means thereby forming a permanent print.

The charging of the electrostatographic plate in preparation for the exposure step is accomplished by means of a corona generating device whereby electrostatic charge is applied to the electrostatographic plate to raise it to a potential in the range of approximately 600–1000 volts. Examples of corona generating devices for this purpose are disclosed in U.S. Pat. Nos. 2,777,957 and 2,836,725. In U.S. Pat. No. 2,777,957 a plurality of parallel wires are connected to a high voltage source and supported in a conductive shield that is arranged in closely spaced relation to the surface to be charged. When the wires are energized, corona is generated along the surface of the wires and ions are caused to be deposited on the adjacent photoconductive surface. Suitable means are usually provided to effect relative movement between the surface to be charged and the corona generating device. Such a device may alternatively have a single corona wire, as shown in U.S. Pat. No. 2,836,725.

It has heretofore been established that consistent high quality reproductions can best be obtained when a uniform potential is applied to the electrostatographic plate in preparation of the plate for exposure step. If the electrostatographic plate is not charged to a sufficient potential, the electrostatic latent image obtained upon exposure will be relatively weak and the resulting deposition of developer material thereon will be correspondingly small. If, however, the electrostatographic plate is overcharged, the converse will occur and if overcharged sufficiently, the photoconductive layer of the electrostatographic plate can be permanently damaged. Also, since the contrast value of the electrostatic latent image is related directly to the potential charge on the electrostatographic plate before exposure, it is apparent that if the plate is not uniformly charged over its entire area, the contrast value of the electrostatic latent image obtained upon exposure will vary in different areas on the plate, and an uneven or mottled effect will be visible on the image when developed.

It is therefore important that the coronodes of single or multiple corona generating devices which are stretched between mountings at opposite ends of the device be maintained in taut condition, since slackness and kinks in these coronode wires will result in nonuniformity of the charge applied to the electrostatographic plate.

OBJECTS AND SUMMARY OF THE INVENTION

Accordingly, it is an object of the invention to improve the construction of corona generating devices whereby a uniform and constant electrostatic charge may be deposited on sheet material, a drum or other appropriate surfaces.

A further object of this invention is to improve corona generating devices so that a constant tension is maintained on the corona wire.

A further object is to improve the technique by which corona wires are replaced in corona generating devices usable in electrostatic reproduction machines.

These and other objects of this invention are attained by the provision of a corona generating device including a coronode or corona emitting wire supported between insulating end blocks. The wire adjacent one end thereof carries a mass. One of the blocks has a recess which houses a compression coil spring through which the wire passes. The spring is loaded to continuously bear against the mass to thereby provide a tension force in a direction outward of the device which maintains the wire in a taut condition.

BRIEF DESCRIPTION OF THE DRAWINGS

In order that the invention may be more readily understood, reference will now be made to the accompanying drawings, in which.

DESCRIPTION OF THE PREFERRED EMBODIMENT

Figure 1:
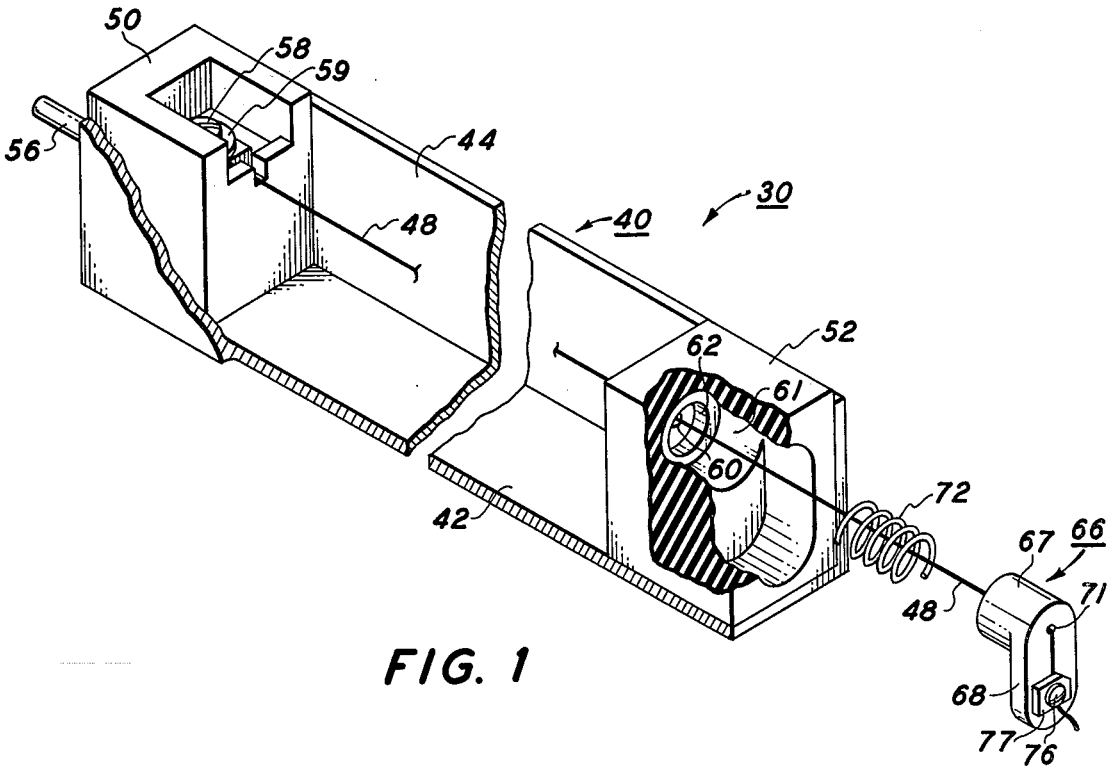
FIG. 1 is a perspective view of one embodiment of corona generating device according to the invention partially broken away for clarity.
Figure 2:
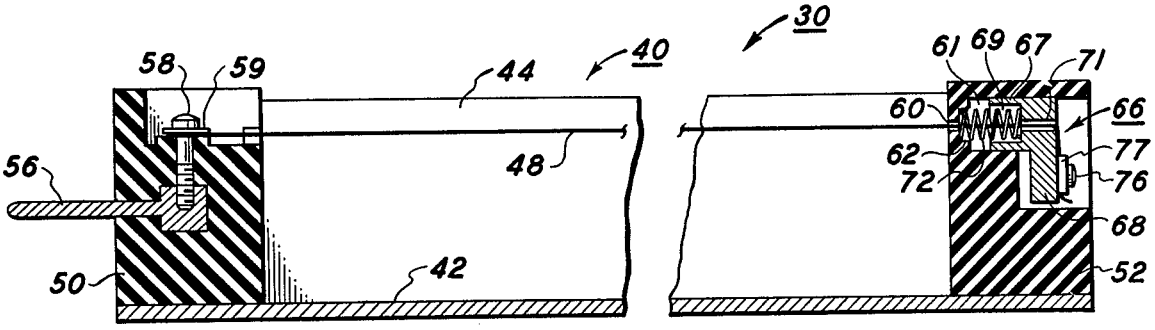
FIG. 2 is a sectional view of the embodiment of FIG. 1, showing the details of mounting assembly.

Referring now to the subject matter of the invention and, in particular, to FIGS. 1 and 2 illustrating a preferred embodiment of the invention, the corona generating device 30 includes a conductive shield 40 preferably of aluminum or stainless steel. The shield has generally a U-shaped cross section and includes a bottom wall 42 and side walls 44 and 46 in perpendicular relation to the bottom wall 42.

The corona charging device is supported in spaced relation to an imaging surface (not shown) of a xerographic reproduction machine by any suitable means and is usually, but not necessarily maintained at electrical or machine ground. The bottom wall 42 of the shield may be provided with rails or similar mounting means of conventional design (not shown) which permit mounting of the device in proper position in the machine.

A thin corona wire 48 of any suitable noncorrosive material such as platinum or stainless steel having a uniform thickness is located within the shield. Support blocks 50 and 52 are rigidly mounted within the side walls 44 and 46 at each end of the shield 40. The support blocks may be fastened in place by screws or permanently held in place by some sort of adhesive. If the shield 40 is made of a plastic material, as is well known in the art, the end blocks 50 and 52 may be made integral with the shield 40 by a molding or extrusion process. The corona wire 48 is attached to the insulating block 50 by means of a conductive connecting screw 58 and washer 59. The screw 50 extends into the body of the block 50 and is threaded into a hole in one end of a high voltage terminal plug 56. The plug extends outwardly of the block 50 for connection in a conventional manner to a high voltage corona generating source (not shown).

The wire 48 adjacent the end remote from the high voltage plug is fastened to an enlarged mass or biasable attachment member 66. The member 66 is generally L-shaped and has a first leg 67 thereof mounted for sliding movement within a first recess 61 of the block 52. A second leg 68 of the member 66 carries an attachment screw 76 which secures the wire 48 to the member 66.

The leg 67 is cylindrical in shape and extends generally parallel to the axis of the wire 48. The outer diameter of leg 67 is selected to be slightly smaller than the inner diameter of the cylindrical recess 61 to permit reciprocating movement therewithin. The leg 67 also has a small diameter bore 71 and a larger diameter recess 69, housing the latter one end of a biasing coil spring 72. The outer end of the spring 72 is supported in another recess 62 in the block 52. A small bore 60 in the block 52 combines with the aforementioned recesses 61, 62, 69 and bore 71 to permit passage of the wire 48 through the block 52 and member 66 for fastening to the screw 76.

It is noted from the above that the spring 72 has one of its ends resting on the shoulder between the recesses 60 and 62 and the other end bearing against the bottom wall of the recess 69 in the member 66. With this arrangement, if the attachment member 66 is drawn inwardly of the device, the spring 72 is compressed or loaded, and in turn, exerts an outward force on the member 66.

The coronode mounting arrangement of the above design provides easy assembly of the corona device and replacement of worn wires. This is accomplished as follows: One end of the wire 48 is first threaded through the bore 61, spring 72, member 66 and attached to the screw 76. The member 66, with the spring 72 in place therein, is then inserted so that the leg 67 slides into the recess 61 with the end of the spirng 72 remote from the member 66 coming to rest in the recess 62.

The other end of the wire 48 is then grasped and drawn inwardly to compress the spring 72 and thereby place the coronode 48 under tension. When proper tension is had, the other end of the wire is wrapped around the screw 58 and fastened in place by tightening thereof. In this condition, the wire is under a preselected stress or tension resulting from the outward force exerted by the spring 72 on the biasable member 66.

It should be noted that the line of action or direction of the force exerted on the wire is coaxial with the axis of the wire. This substantially eliminates the translational forces on the member 66 which would otherwise tend to distort or twist the wire 48 off axis. Translation forces are also avoided by constructing the leg 67 in the form of a cylinder for piston-like movement within a cylinder 61 having an axis coincident with the longitudinal axis of the wire 48.

Thus, the above design provides a resilient mounting. which ensures a high degree of positional accuracy of the coronode wire 48 while holding it under a predetermined tension.

The above description is merely illustrative of an embodiment of the instant invention which may be modified by one skilled in the art within its teaching. Thus, the scope of the invention is intended to be limited only by way of the following appended claims.

What is claimed is:

1. A corona device comprising an elongated coronode supported between first and second fixed support members, means for fixing one end of said coronode to said first support member, a coil spring coaxially carried adjacent the other end of the electrode, an interference member outboard of said spring and attachable to said coronode adjacent said other end thereof, said second member defining a bearing surface against which one end of said spring rests, said second member further comprising first and second bores in communication with each other through which said coronode passes, said bearing surface located intermediate said bores, said second bore housing said spring and having a diameter larger than said first bore, said interference member being reciprocally movable within said second bore, whereby said coronode is placed under tension by fixing said one end of said coronode to said first support member in a position to draw said interference member into loading contact with said spring and place it under tension between said surface and said interference member.

2. The combination recited in claim 1 wherein said interference member is generally L-shaped, one leg of said L being reciprocally movable in said second bore.

3. The combination recited in claim 1 wherein said interference member has a hole therethrough through which said coronode passes, said coronode attaching to said interference member on the side thereof remote from said spring.

4. The combination recited in claim 3 wherein said interference member has a recess, said spring located within said recess adjacent one end thereof.

5. A corona device comprising an elongated coronode supported between first and second fixed support members, means for fixing one end of said coronode to said first support member, a coil spring coaxially carried adjacent the other end of the electrode, an interference member outboard of said spring and attachable to said coronode adjacent said other end thereof, said second member defining a bearing surface against which one end of said spring rests, said second member further defining a channel running parallel to the axis of said coronode, wherein said channel is in the form of a bore and said interference member is in the shape of a cylinder having an outer diameter slightly smaller than the inner diameter of said bore, said interference member movable in piston-like fashion within said bore.

* * * * *